United States Patent [19]

Hill et al.

[11] Patent Number: 4,894,960

[45] Date of Patent: Jan. 23, 1990

[54] CANOPY ASSEMBLY

[75] Inventors: Roger W. Hill; Martin L. Hill, both of Bristol, England

[73] Assignee: Universal Components Limited, Bristol, England

[21] Appl. No.: 176,197

[22] Filed: Mar. 31, 1988

[30] Foreign Application Priority Data

Apr. 2, 1987 [GB] United Kingdom ..... 8707919

[51] Int. Cl.[4] ..... E04F 19/00

[52] U.S. Cl. ..... 52/28; 52/222; 52/508; 40/603

[58] Field of Search ..... 52/222, 28, 287, 28, 52/73, 508; 40/603, 604, 156

[56] References Cited

U.S. PATENT DOCUMENTS

| | | | |
|---|---|---|---|
| 918,966 | 4/1909 | Clark | 52/28 |
| 1,963,662 | 6/1934 | Knapp | 52/287 |
| 2,029,549 | 2/1936 | Wintrich | 52/287 |
| 2,054,189 | 9/1936 | Bemis | 52/287 |
| 3,389,246 | 6/1968 | Schmitz | 52/28 |
| 3,545,145 | 12/1970 | Yousefpor | 52/28 |
| 3,769,502 | 10/1973 | Schultz | 52/28 |
| 4,542,605 | 9/1985 | Gandy | 40/603 |
| 4,580,361 | 4/1986 | Hillstrom | 40/603 |
| 4,674,214 | 6/1987 | Gandy | 40/603 |
| 4,729,074 | 3/1988 | Steadman | 52/28 |
| 4,817,317 | 4/1989 | Kovalak | 40/603 |

FOREIGN PATENT DOCUMENTS

| | | |
|---|---|---|
| 147502 | 7/1984 | European Pat. Off. . |
| 2178085 | 2/1987 | United Kingdom . |

*Primary Examiner*—Henry E. Raduazo
*Attorney, Agent, or Firm*—Larson and Taylor

[57] ABSTRACT

A canopy assembly has an openable panel in a top or bottom wall to allow access to the interior without disturbing the front face member. This may be required e.g. to maintain light fittings or to tension a flexible sheet of the front face member. There may be a pair of upright rear girders and an assembly at the top and/or the bottom comprising a rear transverse member that bridges the girders and has a hinge channel at the front. Brackets project forwardly from the girders and carry a front transverse member. A lid is hingedly engaged in the hinge channel and extends to the front transverse member, which also supports the front face member, a displaceable screen, and a support for light fittings.

3 Claims, 3 Drawing Sheets

CANOPY ASSEMBLY

BACKGROUND OF THE INVENTION

The present invention relates to canopy assemblies such as are commonly used at the edges of roofs of garages, service stations and other commercial premises.

A typical assembly of known type has, at its rear, brackets by which it is mounted to an upright surface of a wall or the edge of a roof. From the top of the bracket, a roof portion projects forwardly. From the outer edge of the roof portion, a canopy member projects downwardly. A reflector screen member may extend at an angle from an outer region of the roof portion rearwardly and downwardly so as to conceal the means by which the assembly is mounted. It may also conceal other elements, e.g. wiring and starters for lighting. From time to time it may be necessary to gain access to components within the assembly, e.g. for adjustment, or to replace lighting elements. With known assemblies this involves access from the front, with removal or displacement of the canopy member. This is not very satisfactory for a variety of reasons. For neatness of appearance, the canopy member will probably be a unitary member running for the whole width of the roof, and it is thus not easy to displace it. Furthermore, there is a serious risk that it will not be repositioned properly afterwards. It is also likely that the means allowing its displacement will be somewhat unsightly.

SUMMARY OF THE INVENTION

The present invention provides a canopy assembly which permits access from above and/or below, preferably without disturbing the canopy member.

Suitably, the canopy assembly has a removable (e.g. hinged) roof member and/or floor member which can be displaced to allow access to the interior. The assembly may include rear bracket means defining a longitudinal channel in which a bead portion at the rear of the roof member of floor member is hingedly received. There may be an internal screen or wall member which is displaceable to facilitate access. Thus it may comprise a resilient sheet which can be flexed for disengagement from a retaining formation.

BRIEF DESCRIPTION OF THE DRAWINGS

Some embodiment of the invention will now be described in greater detail with reference to the accompanying drawings in which.

DESCRIPTION OF THE PREFERRED EMBODIMENTS

Figure 1:
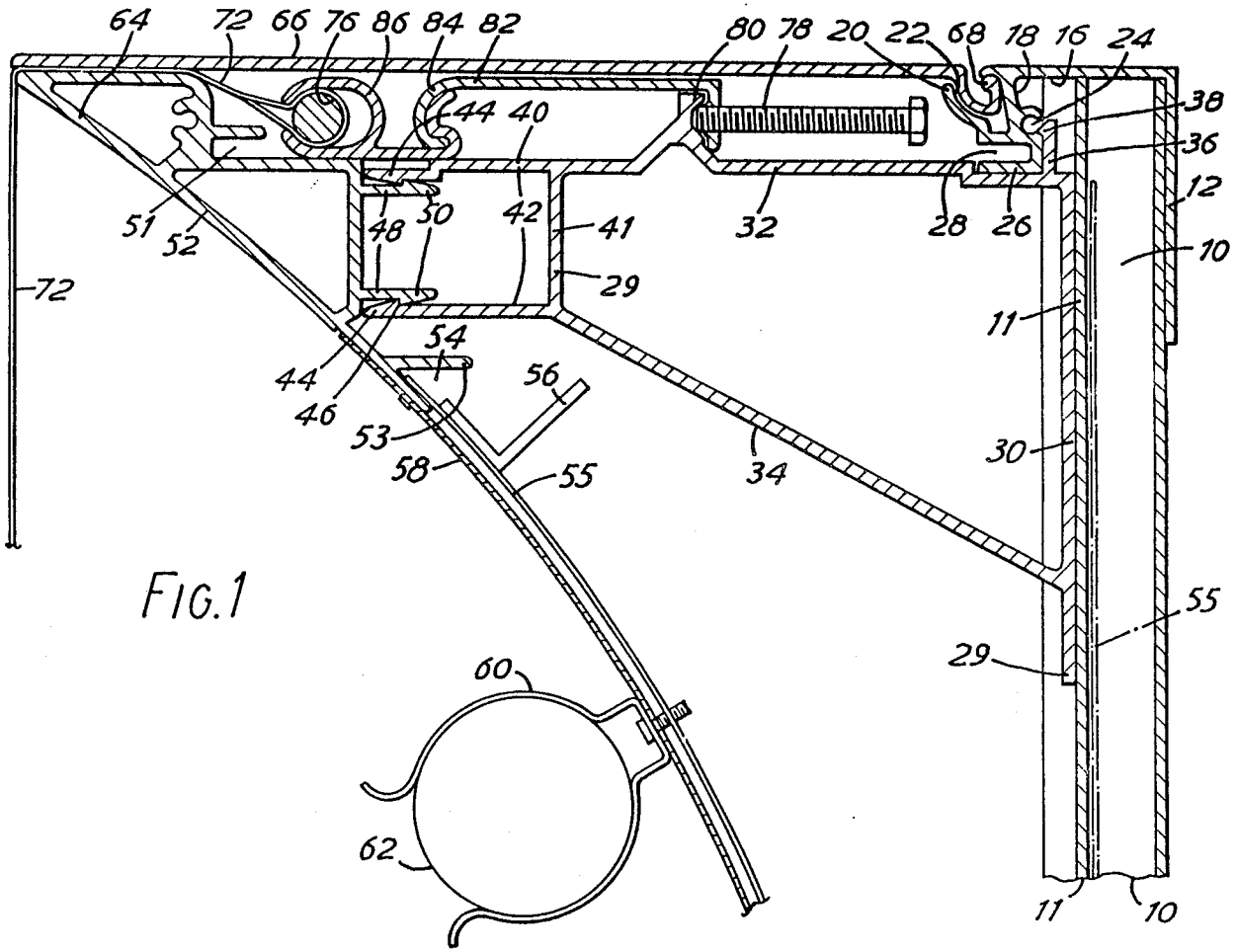
FIG. 1 is a vertical section through a first embodiment of the invention, which is a canopy assembly with a tensioned vinyl face, the section being through a support girder.

In both embodiments, there are standard rear support girders 10 adjacent either end. These are forwardly open channel extrusions with support bar portions 11 extending vertically in the middles of the channels. There may be identical arrays at top and bottom. The top array of FIG. 1 will now be described. A hinge bracket 12 is an extrusion extending the length of the assembly. It has a channel portion 16 that engages over the top of the support girders 10. At the front, this comprises a downwardly projecting limb 18 of complex shape. An arm 20 extends forwardly and upwardly so as to define a slightly narrow-mouthed channel 22. At the rear, the limb 18 provides a narrow-mouthed channel 24, open to the rear. The lower limb portion that defines the bottom rim of this channel extends downwardly and forwardly, terminating with a horizontally extending flange 26 which defines the bottom of an elongate slot 28, which is open forwardly.

A respective support bracket 29 is secured to a bar portion 11 within the channel of each support girder 10. It has an upright rear portion 30 secured to the support 10. An upper limb portion 32 extends forwardly. A lower limb portion 34 extends forwardly and upwardly from a lower region of the upright portion 30. Adjacent the upright portion 30 there is an upper projection 36 terminating in a tang member 38 that engages in the narrow-mouthed channel 24. At the front of the support bracket 29, there is a forwardly open channel portion 40, having a base portion 41 (which forms a box section by connecting the main limb portions 32,34); and parallel upper and lower limbs 42, each terminating in a tapered head 44 with a rearwardly facing abutment face 46. This channel portion 40 snap-engages with a front piece 64, which has limbs 48 with heads 50 complementary to those of the channel portion 40. There is a channel 51 in line with the slot 28 of the hinge bracket so they can receive opposite edge portions of a sleeve plate (not shown). The front piece 64 extends for the full length of the canopy portion. It has a front face 52 that curves downwardly and rearwardly. Adjacent its bottom edge there is a rearward flange 53 defining a channel 54 for receiving the upper marginal portion of a reflector screen 55. The screen 55 is a resiliently flexible sheet, e.g. of aluminium, having a handgrip 56 adjacent its top edge. (It may be symmetrical, with a lower handgrip.) It extends between the two support brackets 29, being slightly less wide than their spacing. Thus, using the handgrip 56, it can be flexed, disengaged from the channel 54, and moved rearwardly (e.g. pivoting about its lower edge in a lower channel) to the position shown in phantom.

A pair of lighting support strips 58 are secured to respective brackets 29. Each is curved similarly to the shape to which the screen is constrained when in its forward position. The strips 58 are then slightly in front of the screen and overlap it to a small extent. They bear retaining clips 60 for fluorescent tubes 62.

A roof panel 66 extends for the full length of the assembly. It is a plate member with a shaped portion at its inner margin. This shaped portion provides a bead 68 that engages pivotally within the channel 22 of the hinge bracket 12. At the front, the roof panel 66 abuts the front piece 64. It may be releasably secured thereto, e.g. by means of screws. The starter etc. for the tubes may be mounted to the underside of the roof panel 66.

In the embodiment shown in FIG. 1, the visible canopy facia is provided by a tensioned flexible sheet 72, suitably of vinyl. At the top this passes over the front piece 64. Its edge is turned back and sealed to form a channel containing a rod 76. This is engaged by a tensioning assembly. This employs a screw bolt 78 rotatably mounted on an arm 80 projecting above the upper limb 32 of the support bracket 14. A tensioning member 82 has a rear limb with an aperture threadedly engaged with the bolt 78, and a front limb 84 which engages a carrier member 86 which supports the rod 76 that holds the sheet 72. The tensioning member 82 and carrier 86 can slide rearwardly, so that the tension of the sheet 72 can be varied by rotating the bolt 78. Of course, when a canopy assembly is first installed, the tension of the face should be set correctly. But in time it is likely to slacken. It can then easily be adjusted by opening the roof panel 66, and operating the bolts 78.

Figure 2:
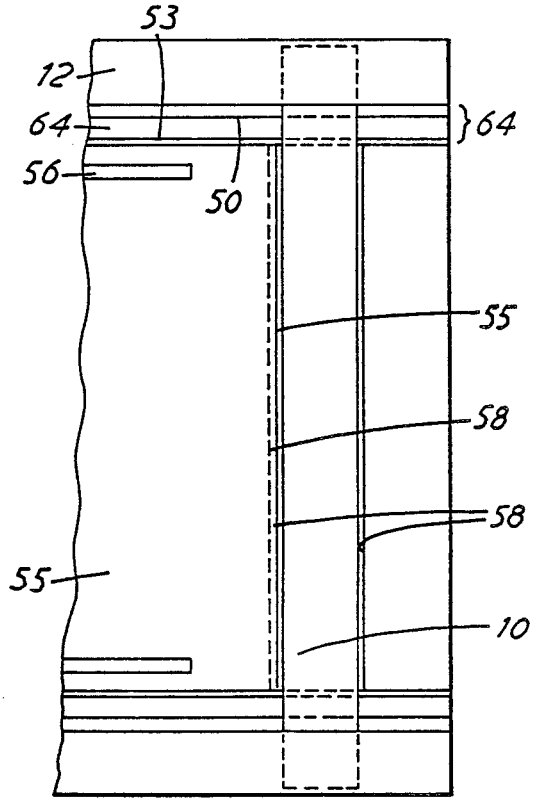
FIG. 2 is a rear elevation on a smaller scale of an end portion.
Figure 3:
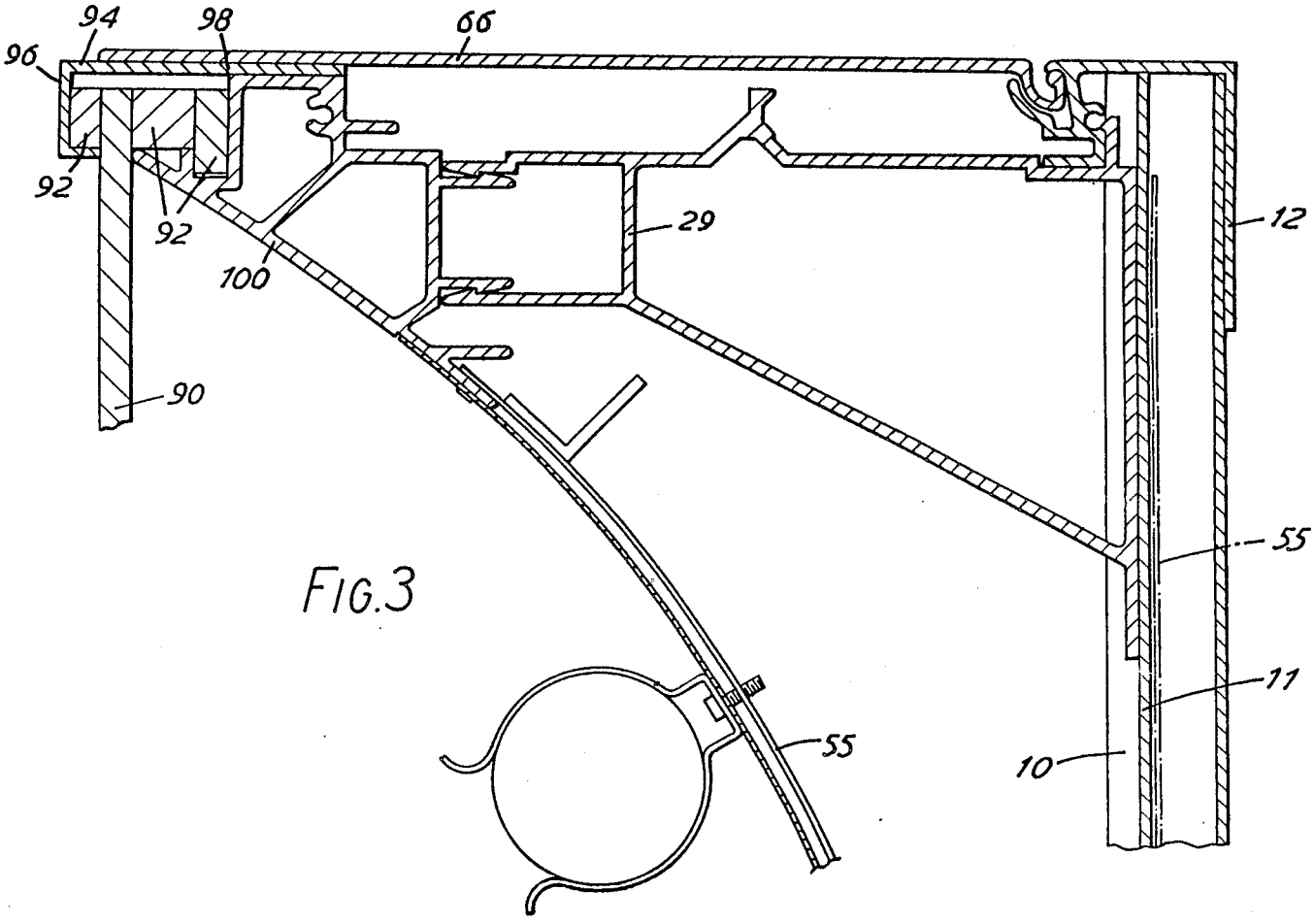
FIG. 3 is a view like FIG. 1 of a second embodiment, which is a canopy assembly with an assembly employing a rigid canopy member.

In the embodiment shown in FIG. 2, most of the components are the same as in the first embodiment, and are referred to by the same reference numerals. However the visible canopy face is provided by a rigid panel 90, suitably of acrylic sheet. At the upper edge, this is gripped between bars 92. They are held by a front bracket 94 having a front limb 96 that extends downwardly and underneath the front bar 92. The upper limb 98 extends rearwardly over the front piece 100 to which it is retained, e.g. by screws which hold the roof panel 66 closed.

A canopy assembly according to either embodiment may be symmetrical, with substantially identical arrays at top and bottom. Thus, for maintenance (e.g. to replace a tube 62 or, in the first embodiment, to adjust the tension of the sheet 72) one opens a roof (or floor) panel 66 and, if necessary, displaces the screen 55. The visible front of the assembly (provided by the sheet 72 or panel 90) need not be disturbed.

Whereas some preferred embodiments have been described, the skilled reader will appreciate that many alternatives and modifications are possible within the spirit and scope of the invention. It is intended to include all such alternatives and modifications within the scope of the following claims.

We claim:

1. A canopy assembly for mounting to an upright surface so as to extend horizontally therefrom, said canopy assembly having lateral ends, a top, a bottom and a rear, and further comprising:

(a) respective vertically extending rear support girders at the lateral ends of the canopy assembly, said support girders having rear faces which define the rear of the canopy assembly;

(b) a pair of substantially identical upper and lower support arrays mounted respectively at the top and the bottom of the canopy assembly in relatively inverted orientations, each said support array comprising:

(i) a hinge bracket that extends the full length of the canopy assembly, said hinge bracket having a channel portion which provides a channel extending the full length of the canopy assembly, the channel in the upper support array being open downwardly and the channel in the lower support array being open upwardly, and said rear support girders having upper and lower end portions engaged in respective channel portions of the hinge brackets, said hinge bracket further comprising, forwardly of the channel portion thereof, an arm shaped to define a narrow-mouthed channel which extends the full length of the canopy assembly;

(ii) a pair of support brackets extending forwardly from respective rear support girders;

(iii) a front piece extending the full length of the canopy assembly and carried by the support brackets; and (iv) an openable roof panel extending the full length of the canopy assembly and having a rear bead portion hingedly received in the narrow-mouthed channel of the hinge bracket so that said roof panel is pivotable about the narrow-mouthed channel between a normal position within the roof panel extends forwardly to abut the front piece and a further position wherein an access opening is provided between the front piece and the hinge bracket;

(c) a visible canopy facia extending between the front piece of the top and bottom arrays to provide the front faces of the canopy assembly; and (d) lighting means, mounted within the canopy assembly so as to be accessible through said access opening when said roof panel is in the further position thereof, for illuminating the canopy facia from behind.

2. A canopy assembly according to claim 1 wherein the canopy facia comprises a tensioned flexible sheet; and a tensioning assembly for said sheet therefor is mounted on said support arrays so as to be accessible through said access opening.

3. A canopy assembly according to claim 2 wherein, at top and bottom, the flexible sheet passes over the front piece and extends rearwardly to said tensioning assembly, said tensioning assembly comprising a displaceable carrier member to which the sheet is affixed and means, accessible through said access opening, for displacing the carrier member rearwardly to tension the sheet.

* * * * *